US007753468B2

(12) United States Patent
Endo et al.

(10) Patent No.: US 7,753,468 B2
(45) Date of Patent: Jul. 13, 2010

(54) ELECTRODE CONTAINER BOX, PRINTING DEVICE AND NOZZLE INSPECTION METHOD

(75) Inventors: Hironori Endo, Suwa (JP); Jun Shimazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 609 days.

(21) Appl. No.: 11/606,923

(22) Filed: Dec. 1, 2006

(65) Prior Publication Data

US 2007/0134969 A1 Jun. 14, 2007

(30) Foreign Application Priority Data

Dec. 1, 2005 (JP) ..... 2005-347775
Oct. 27, 2006 (JP) ..... 2006-292655

(51) Int. Cl.
*B41J 29/393* (2006.01)

(52) U.S. Cl. ..... 347/19; 347/5; 347/10; 347/29; 347/31

(58) Field of Classification Search ..... 439/341
See application file for complete search history.

(56) References Cited

U.S. PATENT DOCUMENTS

2001/0038396 A1* 11/2001 Imanaka et al. ..... 347/7
2003/0160838 A1* 8/2003 Su et al. ..... 347/19

FOREIGN PATENT DOCUMENTS

JP 59-178256 A 10/1984

* cited by examiner

*Primary Examiner*—Stephen D Meier
*Assistant Examiner*—Alexander C Witkowski
(74) *Attorney, Agent, or Firm*—Sughrue Mion, PLLC

(57) ABSTRACT

A cap 41 is used for nozzle inspections for clogging on the basis of a waveform of an output signal at a print head 24 when, in a state in which a potential difference has been generated among the print head 24, a regulating member 143 that is the opposing electrode opposite to the print head 24, or an ink-absorbing member 142, an operation is performed of ejecting ink from the nozzles 23 of the print head 24 to an opposing electrode. The cap 41 comprises a box member 141 in which the regulating member 143 and the ink-absorbing member 142 are contained and an electrode pin 145 that penetrates the box member 141 in a liquid-tight manner, and that is electrically connected with the regulating member 143. Thus, even when ink accumulates in the box member 141 after a nozzle inspection for clogging has taken place, no ink will leak from the part that the electrode pin 145 penetrates.

15 Claims, 15 Drawing Sheets

ELECTRODE CONTAINER BOX, PRINTING DEVICE AND NOZZLE INSPECTION METHOD

BACKGROUND OF THE INVENTION

1. Field of the Invention

The present invention relates to an electrode container box, a printing device and a nozzle inspection method.

2. Description of the Prior Art

As a conventional electrode container box used in the inspection of nozzles for clogging of a print head, known a type has been known of utilizing caps that cover nozzles of the print head at times that printing has been terminated, as for instance, disclosed in Patent Document 1. In Patent Document 1, an inspection of nozzle clogging takes place as follows. Specifically, an opposing electrode that is opposite to the print head is contained in the cap, and a potential difference is generated between the print head and the opposing electrode by not only grounding the opposing electrode to the ground but also by applying voltage to the print head. In such a condition, nozzles are inspected for clogging on the basis of changes that take place in an electric field at the opposing electrode at times when an operation of ejecting ink droplets from nozzles of the print head to the opposing electrode is performed.

[Patent Document 1] JP-A-59-178256

SUMMARY OF THE INVENTION

In Patent Document 1, however, lead wire penetrating inside and outside of the cap connects the opposing electrode contained in the cap with an electric field detection unit located outside the cap, and there has been a risk that ink accumulated in the cap might leak as a result of the penetration.

The present invention was made in order to overcome such a problem, and has one object of providing an electrode container box that is to be used in the inspection of nozzles for clogging, and that is free from leakage of print recording liquid accumulated therein. In addition, another object is to provide a printing device that utilizes the electrode container box, and a nozzle inspection method according to which such an electrode container box can be utilized.

In the present invention, the following measures has been taken to achieve the above objects.

An electrode container box of the present invention used for inspection of nozzles for clogging on the basis of a waveform of an output signal at a print head or an opposing electrode that is opposed to the print head, at a time that an operation of ejecting print recording liquid from a nozzle of the print head to the opposing electrode is performed in a state in which a potential difference has been generated between the print head and the opposing electrode, the electrode container box comprising:

a box member that has an open top and that contains the opposing electrode, and an electrode member that penetrates inside and outside the box member in a liquid-tight manner, and that is electrically connected to the opposing electrode.

In this electrode container box, electrode members electrically connected to the opposing electrode contained in the box member in a liquid-tight manner penetrates inside and outside of the box member. Thus, even if a print recording liquid accumulates in the box member after the inspection of nozzles for clogging has been carried out, there is no leakage of the print recording liquid from any part of the box member that is being penetrated.

The electrode member may be separated from the opposing electrode, or may be made integrally with the opposing electrode. In addition, the shape of the electrode member may not need to be specifically limited; it may be in the form of a column (having a circular, oval or polygonal section), be pointed shape like a cone, or may be in the shape of a plate. In addition to printing by ejecting print recording liquid on sheets, the print head can also be used when a color filter is colored by ejecting print recording liquid that is a coloring material, or when picture elements such as an organic EL display, are formed.

In the electrode container box of the present invention, the electrode member may be pressed into a thorough hole provided in the box member. Doing so makes it easier to maintain a liquid-tight state as the outer surface of the electrode member and the inner surface of the thorough hole are coherent.

In the electrode container box of the present invention, the electrode member may be threaded into a screw hole provided in the box member. By delicately adjusting the extent to which the electrode member is screwed, it is possible to ensure that the electrode member and the opposing electrode are in contact.

In the electrode container box of the present invention, the electrode member may penetrate the box member and is sealed by a sealing member. Even if there is a gap between the electrode member and the box member at a time the electrode member penetrates the box member, it is possible to maintain a liquid-tight state by means of sealing off the gap by a sealing member when the gap is found.

In the electrode container box of the present invention, the electrode member may penetrate the base of the box member. Doing so facilitates fitting of the electrode member if the electrode member is made to stand in advance at a position opposite to the base of the electrode container box when the electrode member is fitted into the electrode container box, and the electrode container box can be lowered onto it almost perpendicular to the electrode container box.

The electrode container box of the present invention may also comprise a recording liquid-absorbing member that is contained in the box member, and that is capable of absorbing the print recording liquid. Doing so enables the recording liquid-absorbing member to absorb recording liquid that is ejected from the print head, thus reducing the chances of the print recording liquid remaining its liquid state inside the box member. The electrode container box of the present invention that has adopted this aspect may comprise a regulating member that is placed on a surface of the recording liquid-absorbing member, that is made in a shape that enables recording liquid ejected from the print head to be transferred to the recording liquid-absorbing member, and that curbs the recording liquid-absorbing member from swelling in an upward direction. As the restricting member curbs from swelling the recording liquid-absorbing member that has absorbed the print recording liquid, this can not lead to a situation in which as a result of repetitions of nozzle inspections, the recording liquid-absorbing member swells to a sufficient extent to establish contact with the print head. In the electrode container box of the present invention described above, the restricting member may also serve as the opposing electrode, and in comparison with cases in which the restricting member and the opposing electrodes are different members, this would lead to a reduction in the number of components.

In the electrode container box of the present invention, in the regulating member, an electrode connection unit that is electrically connected with the electrode member may be integrally formed. What is meant hereby "integrally" is that the restricting member is formed integrally with the electrode connection unit in a seamless manner, and cases in which a separate restricting member and electrode connection unit are combined and formed integrally are not intended to be covered by this definition. In comparison with cases in which the restricting member and the electrode connection unit are different members, the number of components can be reduced. In the electrode container box of the present invention that has adopted this aspect, the electrode connection unit may be pressed by the electrode member, elastically deformed, and electrically connected with the electrode member. Doing so it becomes possible to maintain a condition in which the electrode connection unit and the electrode member are coherent for many years.

In the electrode container box of the present invention comprising the recording liquid-absorbing member, the opposing electrode may be arranged on a rear surface of the recording liquid-absorbing member. In comparison with cases in which the opposing electrode is arranged on the recording liquid-absorbing member, the area of the opposing electrode can be extended, thereby enhancing the accuracy of a inspection of nozzles for clogging. In fact, if the opposing electrode is arranged on the surface of the recording liquid-absorbing member, and the opposing electrode covers the entire area of the recording liquid-absorbing member, the print recording liquid ejected from the nozzles cannot reach the recording liquid-absorbing member. Thus, the opposing electrode needs to be in a form (e.g., like a mesh or a punching plate) that facilitates transfer of the print recording liquid onto the recording liquid-absorbing member. However, as no such a need exists in a case where the opposing electrode is arranged on the rear surface of the recording liquid-absorbing member, the area can be made wider.

Furthermore, an electrode container box of the present invention comprising the recording liquid-absorbing member may comprise a print head-abutting rim provided around a periphery of the opening of the box member so as to be higher that the surface of the recording liquid-absorbing member. As this makes it possible to inspect nozzles for clogging with the print head abutting onto the print head-abutting rim, stable inspection results can be obtained. At such a time, it is preferable that the print head-abutting rim has electrical insulation, and more preferable that it be made of an elastomer having electrical insulation. In such cases, prevention of leakages of current between the opposing electrode and the print head can be facilitated, and, a potential difference can be generated between the opposing electrode and the print head. In addition, the print head-abutting rim may be made of an elastomer having electrical insulation, and be made integral with a sealing unit that enables the electrode member to penetrate the inside and outside of the box member in a liquid-tight manner. What is meant hereby "integrally" is that the print head-abutting rim is formed integrally with the sealing unit in a seamless manner, and cases in which a separate print head-abutting rim and a sealing unit are combined and formed integrally are not intended to be covered by this definition. In comparison with cases in which the print head-abutting rim and sealing unit are different members, the number of components can be reduced.

The electrode container box of the present invention comprising the recording liquid-absorbing member and the print head-abutting rim can be further provided in the box member, and may also comprise a suction port that is used when the print recording liquid absorbed in the recording liquid-absorbing member is sucked out to the exterior, in a condition in which the print head-abutting rim is in contact with the print head. This makes it possible to suck out efficiently to the exterior the print recording liquid that is absorbed in the recording liquid-absorbing member, thereby preventing deposits having constituents derived from the print recording liquid from accumulating on the surface of the recording liquid-absorbing member. The electrode container box of the present invention that has adopted this aspect may also be used at the time that the nozzles of the print head are cleaned, and eliminates the need for providing separate areas both for cleaning of the nozzles and for inspecting the nozzles for clogging.

A printing device of the present invention comprises:

an electrode container box according to any of the electrode container boxes described above; and a print mechanism that performs printing by ejecting recording liquid from the nozzles of the print head toward a medium.

In the printing device, an electrode member electrically connected to an opposing electrode contained in a box member of the electrode container box penetrates the inside and outside of the box member in a liquid-tight manner. Thus, even when a print recording liquid has accumulated in the box member after an inspection of nozzle clogging has taken place, there is no leakage of the print recording liquid from any part of the box member that is being penetrated.

A nozzle inspection method of the present invention includes the steps of:

(a) arranging a print head so that it is opposite to the opposing electrode provided in any of the electrode container box described above; and (b) after step (a), inspecting nozzles for clogging on the basis of a waveform of an output signal at a print head or an opposing electrode that is opposed to the print head, at a time that an operation of ejecting print recording liquid from a nozzle of print head to an opposing electrode is performed in a state in which a potential difference has been generated between the print head and the opposing electrode.

According to the nozzle inspection method, the electrode member electrically connected to the opposing electrode contained in the box member of the electrode container box penetrates the inside and outside of the box member in a liquid-tight manner. Thus, even when print recording liquid has accumulated in the box member after an inspection of nozzle clogging has already taken place, there is no leakage of the print recording liquid from any part of the box member that is being penetrated.

DESCRIPTION OF THE PREFERRED EMBODIMENTS

Figure 1:
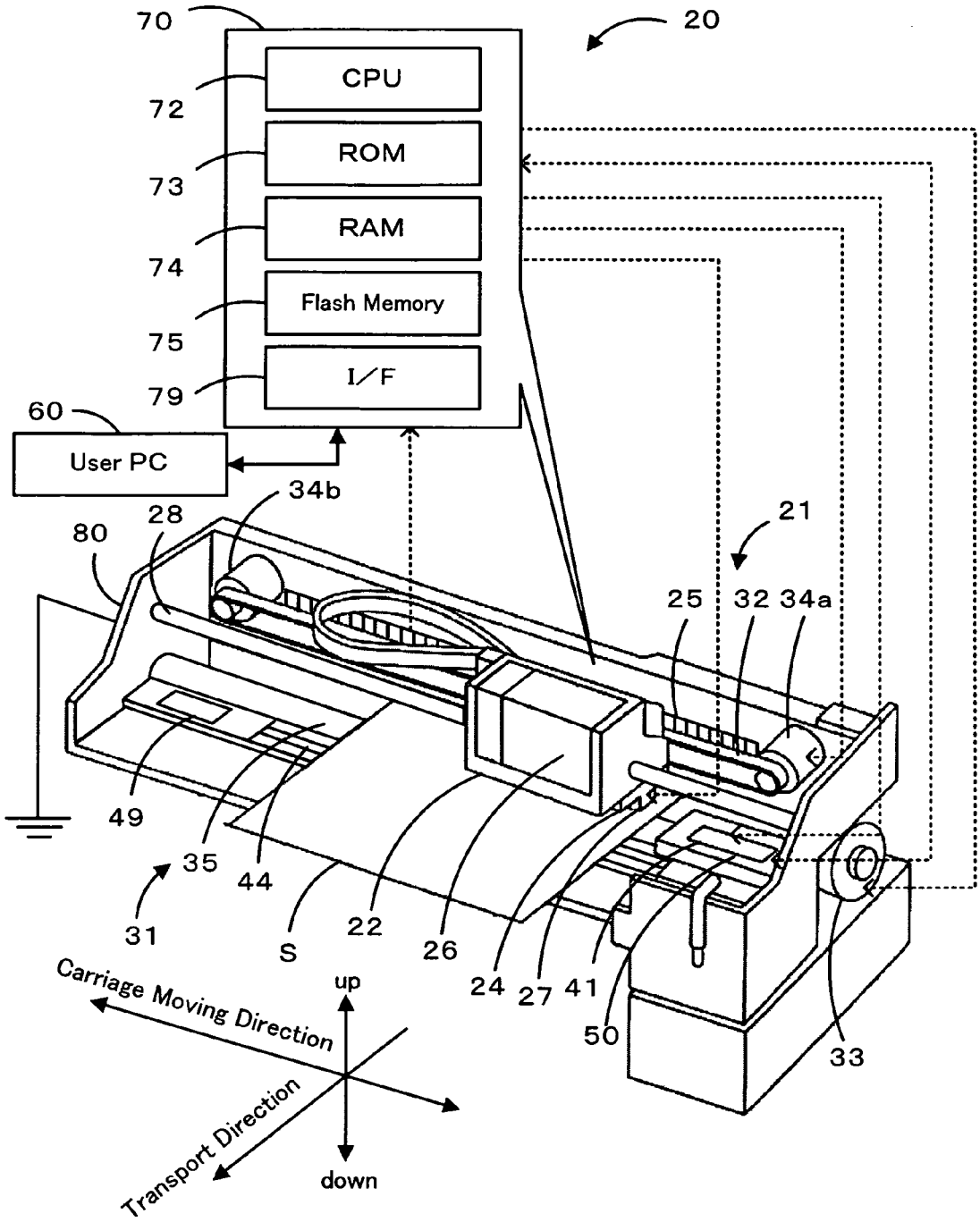
FIG. 1 is a block diagram schematically illustrating a configuration of an ink jet printer 20.
Figure 2:
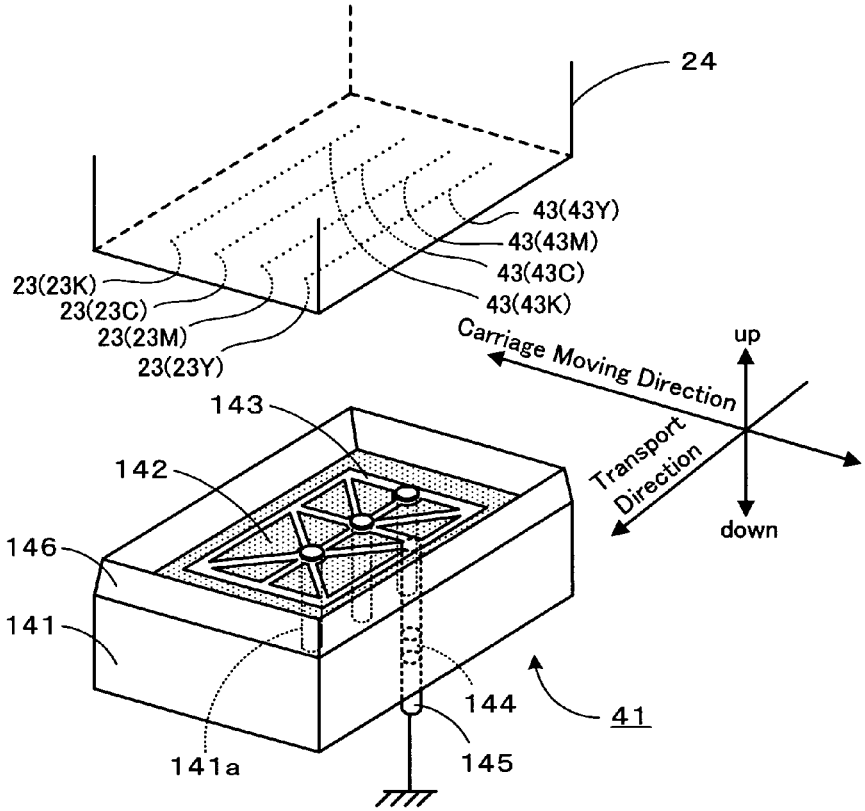
FIG. 2 is a perspective view in which a print head 24 is opposite to a cap 41.
Figure 3:
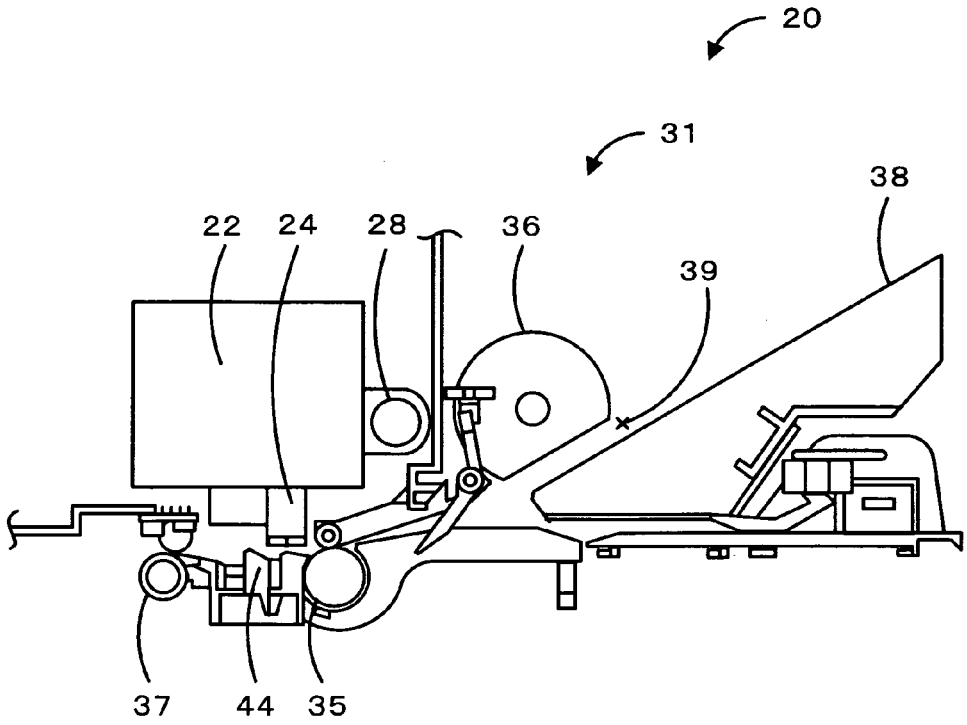
FIG. 3 is an illustration of a paper handling mechanism 31.
Figure 4:
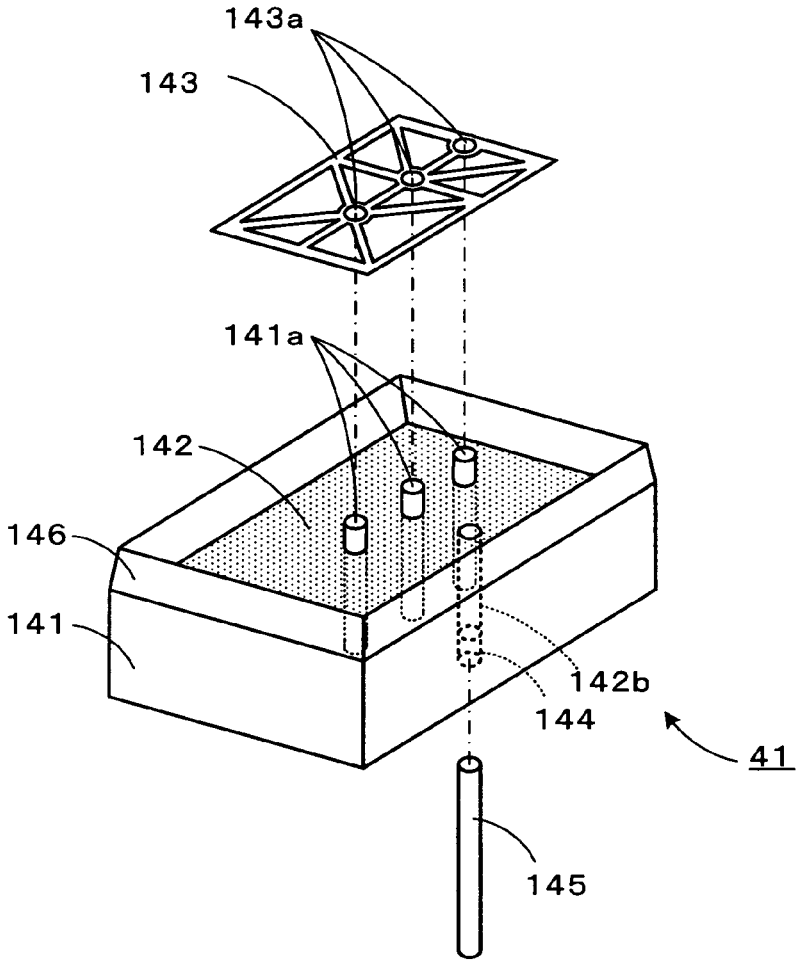
FIG. 4 is an exploded perspective view of the cap 41.
Figure 5:
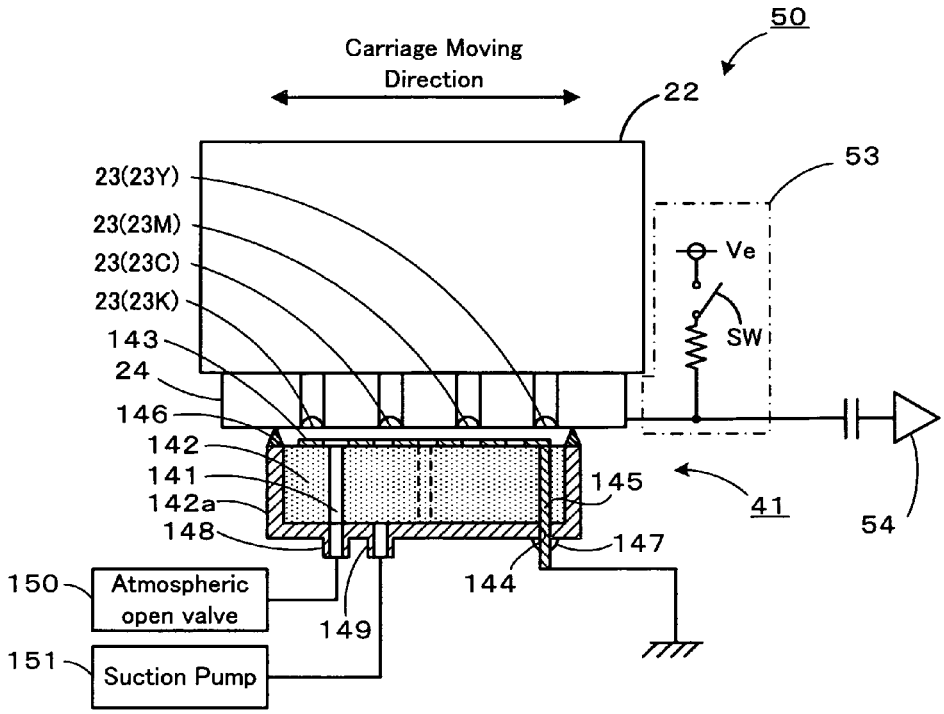
FIG. 5 is a block diagram schematically illustrating a configuration of a print head inspection device 50.
Figure 6:
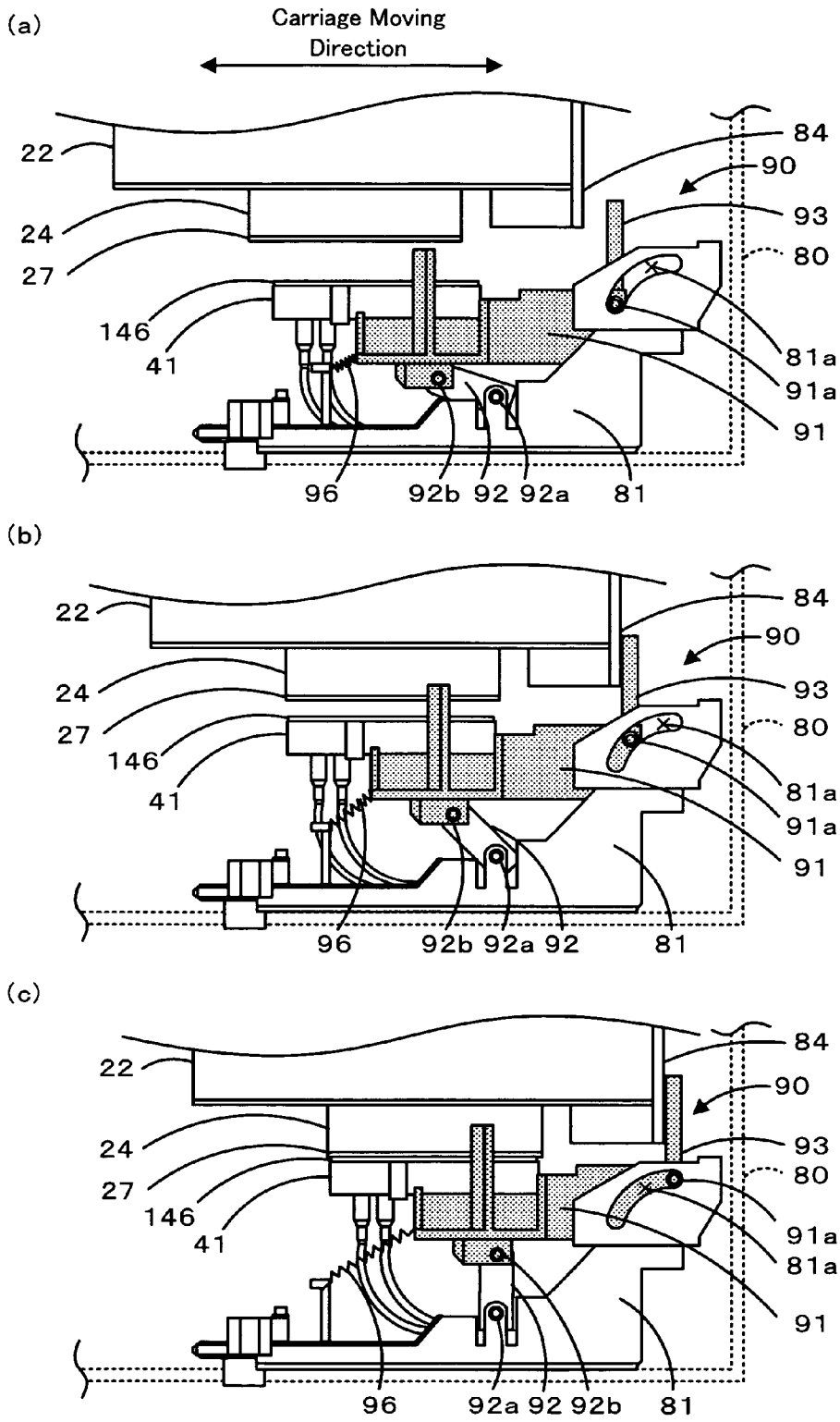
FIG. 6 is an illustration of a cap elevator mechanism 90.

Next, one embodiment of the present invention is described. FIG. 1 is a block diagram schematically illustrating a configuration of an ink jet printer 20 that constitutes this embodiment. FIG. 2 is a perspective view in which a print head 24 is opposite to a cap 41. FIG. 3 is an illustration of a paper handling mechanism 31. FIG. 4 is an exploded perspective view of the cap 41. FIG. 5 is a block diagram schematically illustrating a configuration of a print head inspection device 50. FIG. 6 is an illustration of a cap elevator mechanism 90. FIG. 6 (*a*) illustrates a print head 24 that is not opposite to the cap 41. FIG. 6 (*b*) illustrates a print head 24 that is opposite to, and separated from, the cap 41. FIG. 6 (*c*) illustrates a print head 24 that abuts on the cap 41.

As illustrated in FIG. 1, the ink jet printer 20 of the present invention comprises: a printer mechanism 21 that performs printing by jetting ink droplets onto a recording sheet S to be transported over a platen 44, as seen from the back to the front of the view; a paper handling mechanism 31 including a paper feed roller 35 driven by the drive motor 33, a cap 41 formed in the vicinity of the right end of the platen 44, a print head inspection device 50 formed inside the cap 41 and for checking whether or not the print head 24 is ejecting ink droplets normally; and a controller 70 that controls the entire ink jet printer 20.

The print mechanism 21 comprises: a carriage 22 reciprocating from side to side along a guide 28 by means of a carriage belt 32, ink cartridges 26 mounted onto the carriage 22 and individually containing ink of respective colors of yellow (Y), magenta (M), cyan (C), and black (K); and a print head 24 that applies pressure to each ink supplied from the ink cartridges 26. The carriage 22 moves as the carriage belt 32, installed between a carriage motor 34*a* mounted onto the right of a mechanical frame 80 and a driven roller 34*b* mounted onto the left of the mechanical frame 80, is driven by the carriage motor 34*a*. On the rear surface of the carriage 22 is arranged a linear encoder 25 for detecting a position of the carriage 22, thus making it possible to control a position of the carriage 22 by use of this linear encoder 25. The ink cartridges 26 comprise containers (not shown), respectively containing cyan (C), magenta (M), yellow (Y) and black (K) ink for printing, inks that are composed of water as solvents and dyes, or pigments, as colorants, and that can be attached to, and removed from, the carriage 22. In addition, a flashing area 49 is formed off a printable area at the left end of the platen 44. The flashing area 49 is used to carry out a so-called flashing operation that ejects ink droplets on a regular basis, or at predetermined timings and independent of printing data, in order to prevent ink at the tip of the nozzle 23 from drying and solidifying.

As illustrated in FIG. 2, in the print head 24 are provided nozzle arrays 43 comprised of a plurality of nozzles 23 that eject respective inks of cyan (C), magenta (M), yellow (Y) and black (K). In this context, all the nozzles are collectively referred to as nozzles 23; all the nozzle arrays 43 are collectively referred to as nozzle arrays 43; the cyan nozzle and the cyan nozzle array are respectively referred to as the nozzle 23C and the nozzle array 43C; the magenta nozzle and the magenta nozzle arrays are respectively referred to as the nozzle 23M and nozzle array 43M; the yellow nozzle and the yellow nozzle array are respectively referred to as the nozzle 23Y and the nozzle array 43Y; and the black nozzle and the black nozzle array are respectively referred to as the black nozzle 23*k* and nozzle array 43K. In the respective nozzle arrays 43C, 43M, 43Y and 43K, 180 each of nozzles 23C, 23M, 23Y, and 23K is arranged along the transport direction of the recording sheet S. Piezoelectric elements (not shown) for ejecting ink droplets are provided in respective nozzles 23C, 23M, 23Y and 23K. When voltage, for instance, is applied to a piezoelectric element provided in the nozzles 23C, the piezoelectric element is deformed and pressurizes ink in the nozzles 23C, thereby ejecting ink from the nozzles 23C. Although a method of deforming a piezoelectric element and pressurizing ink has herein been adopted in the print head 24, a method of applying voltage to a heat element (such as a heater), heating ink, and pressurizing ink by generated air bubbles may alternatively also be adopted.

As shown in FIG. 3, the paper handling mechanism 31 comprises a recording sheet insertion port 39 through which a recording sheet S placed on the paper feed tray 38 is inserted; a paper feed roller 36 for supplying to the print head 24 the recording sheet S placed on the paper feed tray 38; a line feed roller 35 for carrying the recording sheet S or roll of paper; and a paper ejection roller 37 for ejecting a printed recording sheet S. The paper feed roller 36, the line feed roller 35 and the paper ejecting roller 37 are driven by the drive motor 33 (see FIG. 1) through a gear mechanism (not shown). A rotating drive force and frictional resistance of a separating pad (not shown) prevent more than one recording sheet S from being fed at one and the same time. In FIG. 1, a transport direction of the recording sheet S is a direction from the back to the front, and the moving direction of the carriage 22 that moves with the print head 24 is the direction (main scanning direction) orthogonal to the transport direction of the recording sheet S.

The cap 41 corresponds to an electrode container box of the present invention, and is positioned off to the right of the printable area of the platen 44 as illustrated in FIG. 1. As illustrated in FIG. 2, the cap 41 comprises a box member 141 that is shaped almost like a rectangular body, with its top open, an ink-absorbing member 142 contained in the box member 141, a regulating member 143 arranged on the top surface of the ink-absorbing member 142, and an electrode pin 145 that is pressed into a through hole 144 provided on the base of the box member 141, passing through the ink-absorbing member 142 and electrically connected to the regulating member 143. The box member 141 is formed of resin and above the surface of the ink-absorbing member 142, a head-abutting rim made of electrically insulating silicone rubber is provided around the periphery of the opening. The ink-absorbing member 142 is made of an ester-group urethane sponge (product name: Ever Light SK-E, manufactured by Bridgestone Corporation) that has a high degree of penetration such that ink droplets that have landed can move down promptly, or of any material having a relatively high retention of ink (such as a non-woven fabric like a felt (product name: Kinocloth manufactured by OJI KINOCLOTH CO., LTD.)). A two-stage structure may also be adopted wherein a material of a high degree of ink penetration at the upper level is placed on a material of a high degree of ink retention at the lower level. The regulating member 143 is formed of a mesh stainless (e.g., SUS) sheet, and not only prevents the ink-absorbing member 142 from absorbing ink and swelling in an upward direction but also serves as an opposing electrode that is opposite to the print head 24 when an inspection of nozzle clogging takes place. As the regulating member 143 is formed like a mesh, it allows ink ejected from the print head 24 to move in the ink-absorbing member 142. In addition, as illustrated in FIG. 4, when the regulating member 143 is placed on the top surface of the ink-absorbing member 142, it is caulked by inserting heads of three supporting rods 141*a* integrally formed on the base of the box member 141 into circular holes 143*a* provided at the crossing points of the mesh, and by then heating and pressurizing the heads. As illustrated in FIG. 4, after the electrode pin 145 has been pressed from beneath the bottom of the box member 141 into a through hole 144, the periphery of the through hole 144 is sealed by a sealing member 147 (See FIG. 5). A synthetic rubber adhesive, for example, may be used as the sealing member 147. As a result, the electrode pin 145 penetrates through the box member 141 in an air-tight and liquid-tight manner. The electrode pin 145 is grounded to the ground by way of the mechanical frame 80 (See FIG. 1). In addition, a guide hole for passing the electrode pin 145 may be provided in advance in the ink-absorbing member 142. As illustrated in FIG. 5, on the base of the box member 141 are provided a vent hole 148 that is connected to an atmospheric open valve 150 and a suction port 149 that is connected to a suction pump 151. The suction port 149 is used to drive the suction pump 151 with the atmospheric open valve 150 closed and the head-abutting rim 146 abutting onto the print head 24 and thus to generate a negative pressure in an internal space surrounded by the print head 24 and the box member 141, and cause the suction pump 151 to suction forcibly ink absorbed in the ink-absorbing member 142, or ink within the nozzles 23. Further, after such forcible suction, the vent hole 148 is used to open the atmospheric open valve 150 and thus to restore the internal space of negative pressure to atmospheric pressure. In the ink-absorbing member 142, a communicating hole 142*a* (See FIG. 5) is provided directly above the vent hole 148 for communicating with the internal space and a communicating hole 142*b* (See FIG. 4) is provided directly above the through hole 144 for communicating with the internal space. As well as being used to inspect the nozzles for clogging, the cap 41 is also used to seal off the nozzles 23 for preventing the nozzles 23 from drying, for instance, during periods when printing has been suspended.

As shown in FIG. 6, the capping member elevation mechanism 90 comprises a capping member frame 81 fixed at the right lower end inside the mechanical frame 80, in the Figure, a connecting member 91, to which the cap 41 is connected and which is supported so that it can travel below the carriage 22 and above the capping unit frame 81, a link arm 92 for movably supporting the connecting member 91, and a pulling spring 96 connected to the capping member frame 81 and the connecting member 91 and always pulling the connecting member 91 in the lower left direction in the Figure. In FIG. 6, to facilitate understanding, the connecting member 91 has been hatched. In addition, although the capping unit frames 81 stand respectively at the front, and at the back, of the connecting member 91, FIG. 6 reveals only the front side. At one end of the connecting member 91 a columnar body 93 is provided that extends in an upward direction so that it can abut an abutting member 84 formed at the right end of the carriage 22, and above the other end the cap 41 is provided opposite to the nozzle plate 27 when the abutting member 84 abuts the columnar body 93. In addition, a rod 91*a* protruding to the front, as viewed on the figure, is fixed adjacent to the columnar body 93. One end of the link arm 92 is connected to the lower central part of the connecting member 91 by way of the supporting shaft 92*b*. Into the other end of the link arm 92 has been inserted a turning shaft 92*a* that is fixed at practically the center of the capping member frame 81. Thus, the link arm 92 is configured so that it can turn around the turning shaft 92*a* while supporting the connecting member 91. On arcuate groove 81*a* is formed on the capping member frame 81, and the rod 91*a* is fitted into the arcuate groove 81*a* so that it can travel along the shape of the channel. In the capping member elevation mechanism 90, when the carriage 22 travels to the right in the figure with the abutting member 84 abutting the columnar body 93, the capping member 41 ascends toward the print head 24 while the nozzle plate 27 surface of the print head 24 and the regulating member 143 surface in the capping member 41 are horizontally opposed to each other and travel to the right. When the rod 91*a* reaches the right end of the arcuate groove 81*a*, the cap 41 is strongly pressed against the nozzle plate 27 (See FIG. 6 (*c*) and FIG. 5). In addition, in the capping member elevation mechanism 90, when the carriage 22 travels to the left with the abutting member 84 abutting the columnar body 93, the cap 41 descends a way from the print head 24 while the nozzle plate 27 surface and the regulation member surface are horizontally opposed to each other and travel to the left.

As illustrated in FIG. 5, the print head inspection device 50 comprises: a cap 41 that has a regulating member 143 on which ink droplets flying out of the nozzles 23 of the print head 24 land, or the ink-absorbing member 142; a voltage application circuit 53 for generating a predetermined potential difference between the ink-absorbing member 142 and the print head 24; and a voltage detection circuit 54 for detecting variations in voltage in the print head 24. The cap 41 is as has already been described earlier. As the ink-absorbing member 142 is used in conditions in which it can be soaked with ink or the like, it has an identical potential to that of the regulating member 143 that is arranged on the surface of the ink-absorbing member 142. The voltage application circuit 53 boosts voltage of a few volts of electrical wiring laid inside the ink jet printer 20 to several tens or hundreds of volts by way of a booster circuit (not shown) and applies boosted voltage Ve to the print head 24 through a switch SW. The voltage detection circuit 54 is connected so as to detect variations in voltage in the print head 24.

As shown in FIG. 1, provided on the main board (not shown) attached to the rear surface of the mechanical frame 80, the controller 70 is configured as a microprocessor that is based on a CPU 72 and comprises a ROM 73, in which various types of processing programs are stored, a RAM 74, in which data are temporarily stored or saved, a flash memory 75 into which data can be written or from which data can be erased, Interface (I/F) 79 for exchanges of information with external appliances, and an input/output port (not shown). In addition, various processing programs as routines such as a main routine, a nozzle inspection routine, a cleaning process routine or a printing process routine, all to be described later, are stored in the ROM 73. In addition, in the RAM 74 a print buffer area is provided in which print data sent from the user PC 60 through the I/F 79 can be stored. As well as a voltage signal outputted from the voltage detection circuit 54 of the print head inspection device 50, or a position signal of the carriage 22 from the linear encoder 25 etc., an item such as a print job outputted from the user PC 60 can also be entered into the controller 70 through the input port (not shown), through I/F 79. In addition, as well as a control signal to the print head, a control signal to the drive motor 33, a drive signal to the carriage motor 34*a*, an operation control signal to the suction pump 151, an opening or closing signal to the atmospheric open valve 150, or a control signal to the voltage application circuit 53, etc., print status information outputted to the user PC 60 can also be outputted from the controller 70 through the output port (not shown), through I/F 79.

Next, an operation of the ink jet printer 20 of the embodiment configured in such a way will be described, in particular, the operation of a nozzle inspection conducted immediately before printing on a recording sheet S. When the nozzle inspection begins, the CPU 72 of the controller 70 first drives the carriage motor 34*a*, not only to move the carriage 22 so that the print head 24 is in a position opposite to the cap 41 (home position), but also to turn on the switch SW of the voltage application circuit 53 and apply voltage to the print head 24. Then, as illustrated in FIG. 5 and FIG. 6 (*c*), the print head 24 abuts on the head-abutting rim 146 of the cap 41. In addition, as the regulating member 143 that is an opposing electrode of the print head 24 is grounded to the ground through the electrode pin 145, a predetermined potential difference is generated between the print head 24 and the regulating member 143. In addition, as the ink-absorbing member 142 is soaked with ink or the like (the ink-absorbing member 142 may be moisturized with ink by preliminary ejection prior to a nozzle inspection) it has an identical potential to that of the regulating member 143. In this state, a pulse is given to a piezoelectric element (not shown) corresponding to, for instance, the first nozzle 23Y in the yellow nozzle array 43Y. In fact, an operation is carried out of ejecting ink droplets from the nozzle 23Y of the print head 24 to the regulating member 143 that is the opposing electrode. Then, if the nozzle 23Y is not clogged, and actually ejects ink droplets onto the regulating member 143, the waveform of an output signal appears as a sine curve in the voltage detection circuit 54. Although the principle of how the output signal waveform is obtained is not known, it is supposedly attributed to induced current flowing as a result of electrostatic induction as charged ink droplets approach the regulating member 143. In addition, the amplitude of the output signal waveform depends not only on a distance from the print head 24 to the regulating member 143, but also presence or absence of flying ink droplets, and the size of any such droplets. Thus, if the nozzle 23Y is clogged and does not therefore eject ink droplets, or ink droplets are larger or smaller than a predetermined size when an operation is carried out of ejecting ink droplets from the nozzle 23Y of the print head 24 onto the regulating member 143 that is the opposing electrode, in comparison with a normal operation, the amplitude of the output signal waveform becomes smaller, or almost zero. In such circumstances, on the basis of the amplitude of the output signal waveform, it becomes possible to make a judgment on whether or not there is any clogging of the nozzle 23. Specifically, after the first nozzle 23Y to the $180^{th}$ nozzle 23Y of the yellow nozzle array 43Y have been inspected, the magenta nozzle array 43M, the cyan nozzle array 43C and the black nozzle array 43K are similarly inspected, and thus all the nozzles 23 of the print head 24 are inspected so as to determine whether or not any clogging exists. Ink droplets ejected from respective nozzles 23 are made to land on any place other than the supporting rod 141*a*.

Next will be described a cleaning operation carried out after the completion of a nozzle inspection. In this case, when cleaning begins, the print head 24 is still at the home position and abuts against the head-abutting rim 146 of the cap 41. When cleaning starts, the CPU 72 of the controller 70 not only closes the atmospheric open valve 150 but also drives the suction pump 151. In this manner, negative pressure is generated in the internal space surrounded by the cap 41 and the print head 24, and ink absorbed in the ink-absorbing member 142 or that within the nozzles 23, is suctioned. Then, after allowing sufficient time to elapse for suctioning ink (time set in advance by experiments, etc.), the CPU 72 terminates the operation of the suction pump 151 and also opens the atmospheric open valve 150. In this manner, the internal space surrounded by the cap 41 and the print head 24 returns to the atmospheric pressure, and thus the carriage 22 can smoothly move when an attempt is made to move it from the home position to the platen 44. In addition, as cleaning is performed every time that a nozzle inspection has been completed, no deposits derived from ink will accumulate on the surface of the ink-absorbing member 142.

According to the embodiment described above, even if ink accumulates in the box member 141 of the cap 41 after an inspection for nozzle clogging has been completed, no ink inside the box member 141 leaks from the through holes 144 because the electrode pins 145 have been pressed into the through holes 144 on the box member 141, and the inner surfaces of the through holes 144 have been closely attached to the electrode pins 145, or because the sealing members 147 sealing off the gap have been formed even when there has been gap between the through holes 144 and the electrode pins 145.

Moreover, as the ink-absorbing member 142 absorbs ink ejected from the respective nozzles 23 of the print head 24, ink does not easily accumulate in the box member 141. Further, the regulating member 143 curbs from swelling the ink-absorbing member 42 that absorbs ink, and in this manner a situation can be prevented in which by means of repetitions of nozzle inspections, the ink-absorbing member 142 swells to a sufficient degree to touch the print head 24 when the print head 24 abuts on the head-abutting rim 146 of the box member 141.

Furthermore, as the head-abutting rim 146 of the box member 141 has electrical insulation and rubber elasticity, even when the regulating member 143 that is the opposing electrode contacts the print head 24, no shorting occurs between the print head 24 and the regulating member 143. It thus becomes possible to conduct a nozzle inspection with the print head 24 abutting onto the head-abutting rim 146. In addition, as negative pressure can be efficiently generated within the internal space surrounded by the print head 24 and the box member 141 even when cleaning is carried out after a nozzle inspection, deposits of constituents derived from ink do not easily accumulate on the surface of the ink-absorbing member 142. In addition, since a relative distance between the print head 24 and the inspection area can be made shorter, the output waveform during a nozzle inspection becomes larger, and inspection accuracy is thus enhanced. Since the relative distance does not fluctuate easily, stable inspection results can be obtained. In addition, as the head-abutting rim 146 has elasticity, the level of shock at a time that the print head 24 makes contact can be alleviated.

In addition, as both a nozzle inspection and cleaning are performed by use of the cap 41, there is no need to provide an area where a nozzle inspection is performed separately from that where cleaning is carried out.

In addition, it goes without saying that, the present invention is not limited to the embodiments described above, but can be carried out in a variety of aspects, as long as these remains within the technical scope of the invention.

For instance, in the embodiment described above, although a nozzle inspection is performed by use of a cap 41 that carries out cleaning, alternatively, a nozzle inspection may be performed by the flashing area 49. In such circumstances, the flashing area 49 needs to be made of a constructional element similar to the cap 41.

In the embodiment described above, although the electrode pin 145 is pressed into the through hole 144 of the box member 141, alternatively, the electrode pin 145 may also be threaded into the through hole 144, by means of providing a female screw on the inner wall of the through hole 144 of the box member 141 and making it into a screw hole, and by providing a male screw to fit into the screw hole on the electrode pin 145. In this way subtle adjustment becomes possible of how far the electrode pin 145 is to be threaded, thereby ensuring that the electrode pin 145 can reliably contact the regulating member 143 that is the opposing electrode.

In the above embodiment, although cleaning is carried out after a nozzle inspection has been completed, it may also be carried out only when a nozzle inspection reveals clogging in any nozzle.

Figure 7:
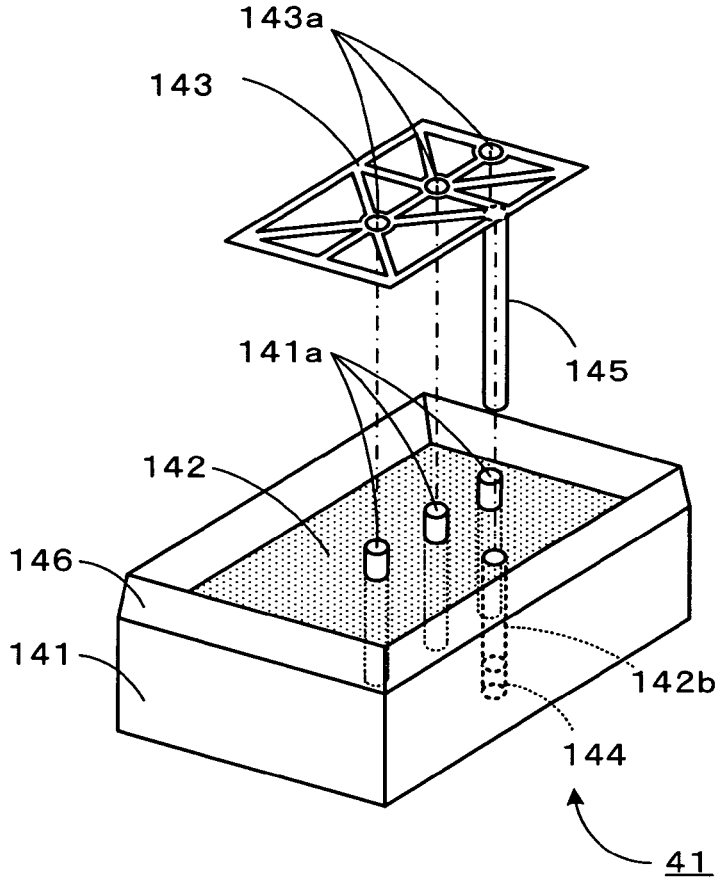
FIG. 7 is an exploded perspective view of the cap 41.

In the embodiment described above, as illustrated in FIG. 4, after the regulating member 143 has been placed on the surface of the ink-absorbing member 142 and caulked by the supporting rod 141*a*, the electrode pin 145 that is a separate object from the regulating member 143 is pressed from beneath the base of the box member 141. However, as illustrated in FIG. 7, the regulating member 143 that is integrally formed with the electrode pin 145 may alternatively be pressed into the through hole 144 from above when the regulating member 143 is placed on the surface of the ink-absorbing member 142.

Figure 8:
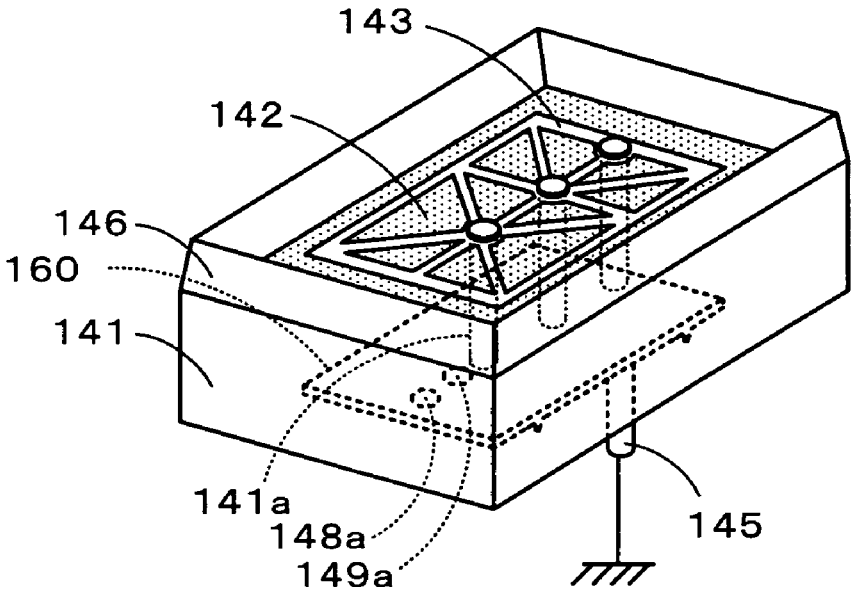
FIG. 8 is a perspective view of a cap having a different form from that of this embodiment.

In the cap 41 of the embodiment described above, although the regulating member 143 is used as the opposing electrode, as illustrated in FIG. 8, for instance, the opposing electrode may be arranged separately from the regulating member 143. In other words, on the rear surface of the ink-absorbing member 142 may be arranged an opposing electrode 160 that has an area equivalent to, or slightly smaller than, the surface of the ink-absorbing member 142. In comparison with a case in which the regulating member 143 is used as the opposing electrode, the area of the opposing electrode can be increased, thereby enhancing the accuracy of inspection of the nozzles 23 for clogging. In other words, when the regulating member 143 is used as the opposing electrode, the regulating member 143 covers the entire surface of the ink-absorbing member 142, and ink ejected from the nozzle 23 cannot reach the ink-absorbing member 142. This is because the ink-absorbing member 142 needs to be made in a shape that allows ink to be transferred to the ink-absorbing member 142 (like a mesh or a punching plate, etc.). In contrast, as no such need exists if the opposing electrode 160 is arranged on the rear surface of the ink-absorbing member 142, the surface can be made wider. In this case, holes are preferably provided in positions corresponding to the vent hole 148 or the suction hole 149 in the opposing electrode 160, as in this way efficiency of ink ejection during suctioning is enhanced and the period during which of the internal space (closed space surrounded by the ink head 24 and the cap 41) returns to atmospheric pressure from negative pressure can be abbreviated. In addition, the opposing electrode 160 has a through hole through which penetrates the supporting rod 141*a* that stands on the base of the box member 141. Then, although the opposing electrode 160 may be one sheet member, as illustrated in FIG. 8, more than one sheet member that is narrower than such a sheet member may be arranged so as to be opposite to the respective nozzle arrays 43.

In the above embodiment, voltage is applied to the print head 24 when a nozzle inspection takes place, while the opposing electrode is grounded to the ground. In contrast, the print head 24 is grounded to the ground while voltage may be applied to the opposing electrode. Further, although an output signal waveform on the print head 24 is detected when a nozzle inspection takes place, in contrast, an output signal waveform on the opposing electrode may be detected.

Figure 9:
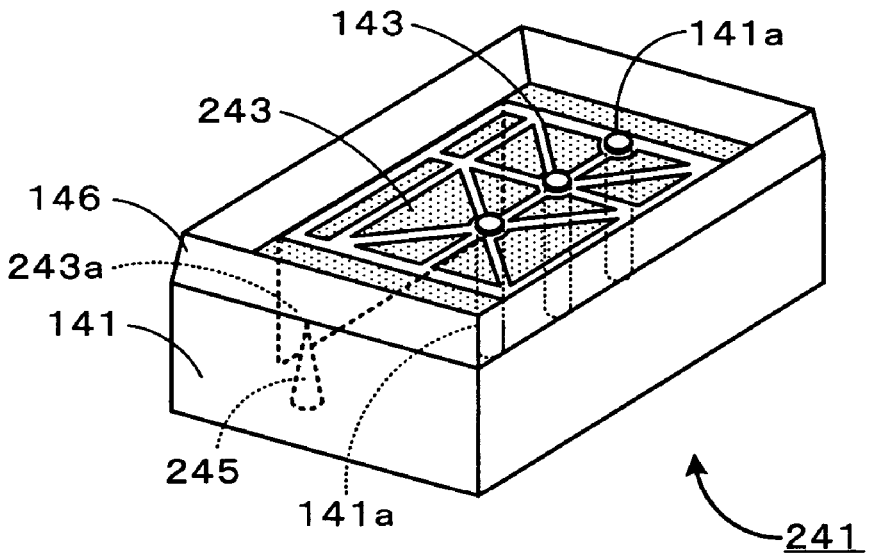
FIG. 9 is a perspective view of a cap 241 having a different form from that of this embodiment.

A cap 241 shown in FIG. 9 may be substituted for the cap 41 of the above embodiment. The cap 241 adopts a regulating member 243 that has a turned back surface 243*a* formed by folding the surface of the ink-absorbing member 142 back to the rear surface, and that is configured so as to have the electrode pin 245 touch the turned back surface 243*a*. As such a time, the electrode pin 245 may penetrate a flank of the box member 141.

Figure 10:
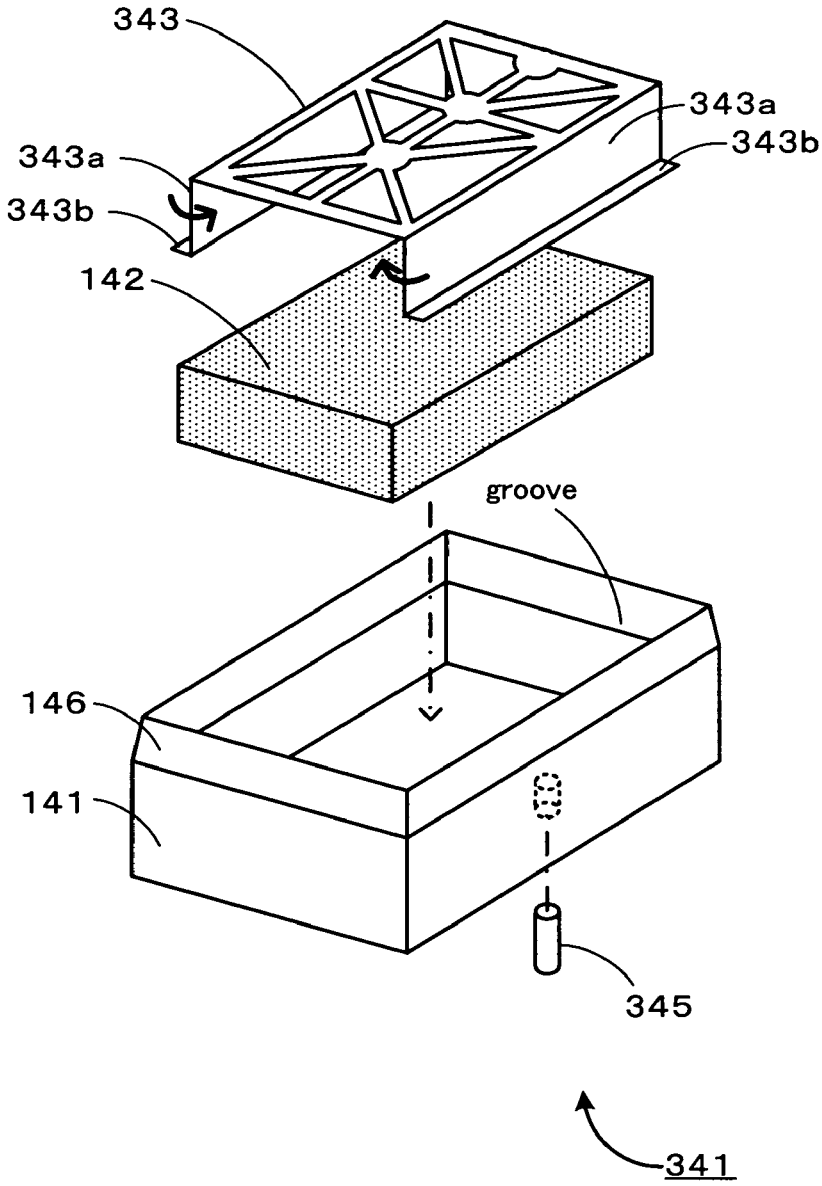
FIG. 10 is an exploded perspective view of a cap 341 having a different form from that of this embodiment.
Figure 11:
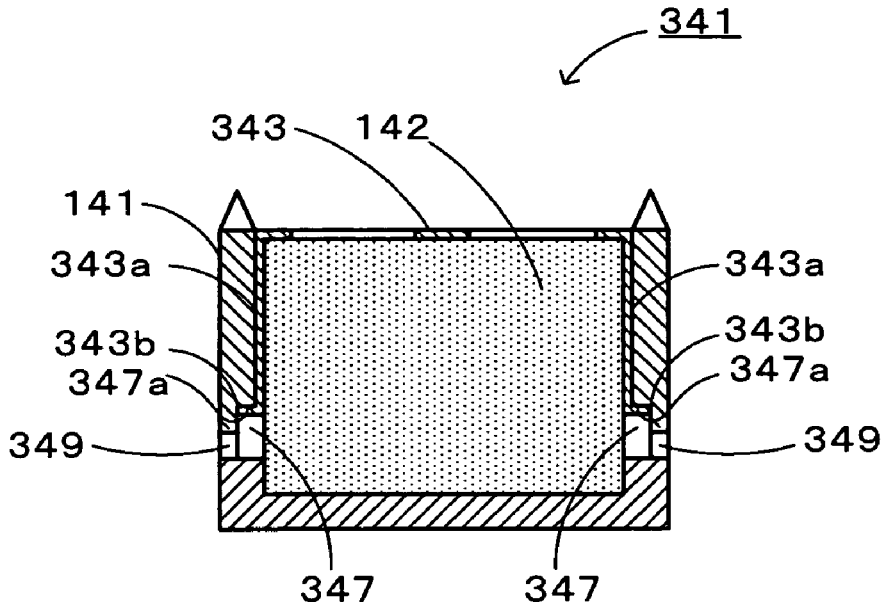
FIG. 11 is a cross sectional view of the cap 341.

In the cap 41 of the above embodiment, although the regulating member 143 is fixed by caulking by means of the supporting rod 141*a* that protrudes onto the box member 141, a cap 341 may also be used, as illustrated in FIG. 10. In the cap 341, the supporting rod 141*a* is dispensed with, and the regulating member 143 may be fixed to the box member 141 by providing on the regulating member legs 343*a*, 343*a* that serve as a plate spring, inserting gabs 343*b*, 343*b* provided on the ends of the regulating member legs 343*a*, 343*a* into the box member 141 as well as the ink-absorbing member 142 with force applied in the direction in which they come close to each other (arrow direction in the figure), and by then releasing the force, which enables the gabs 343*b*, 343*b* to expand in a direction opposite to the arrow direction and press the inner wall of the box member 141. At such a time, on the inner wall of the box member 141 may be provided grooves that the gabs 343*b*, 343*b* can enter. Moreover, the electrode pin 345 may be inserted so as to abut onto the gab 343*b*, or onto the part of the ink-absorbing member 142 that covers the surface, as illustrated in FIG. 4. At such a time, on the inner wall of the box member 141 may be provided stepped grooves that the gabs 343*b*, 343*b* can enter.

Although the vent hole or suction hole has been omitted in FIGS. 9 and 10, they may be formed on the base of the box member 141, in a similar manner to that illustrated in FIG. 5. Alternatively as, in the case illustrated in FIG. 10, on the inner wall of the box member 141 are provided not only stepped grooves 347, 347 into which the gabs 343*b*, 343*b* of the regulating member 343 can enter, but also the penetrating holes 349, 349 that penetrate the stepped grooves 347, 347, one of which may be made a vent hole and the other a suction port. In such circumstances, when the regulating member 343 controls the ink-absorbing member 142 in such a way that it can not swell in an upward direction, pressure is released after the gabs 343*b*, 343*b* have been made to enter the stepped grooves 347, 347, while the top surface of the regulating member 343 presses down the ink-absorbing member 142. Then, the regulating member 343 is biased by the ink-absorbing member 142 in an upward direction, and the gabs 343*b*, 343*b* are hooked onto the top end surfaces 347*a*, 347*a* of the stepped grooves 347, 347. In such a manner, the regulating member 343 is able to curb the ink-absorbing member 142 from swelling in an upward direction. Further, the through holes 349, 349 are not prevented by the legs 343*a*, 343*a* of the regulating member 343 from performing functions such as suctioning.

In the above embodiment, a case has been described in which the present invention is applied to an ink jet printer that for example prints on a recording sheet S. However, this invention may also be applied to the manufacturing of a color filter such as a liquid crystal display, or to the formation of pixels such as an organic EL display.

Figure 12:
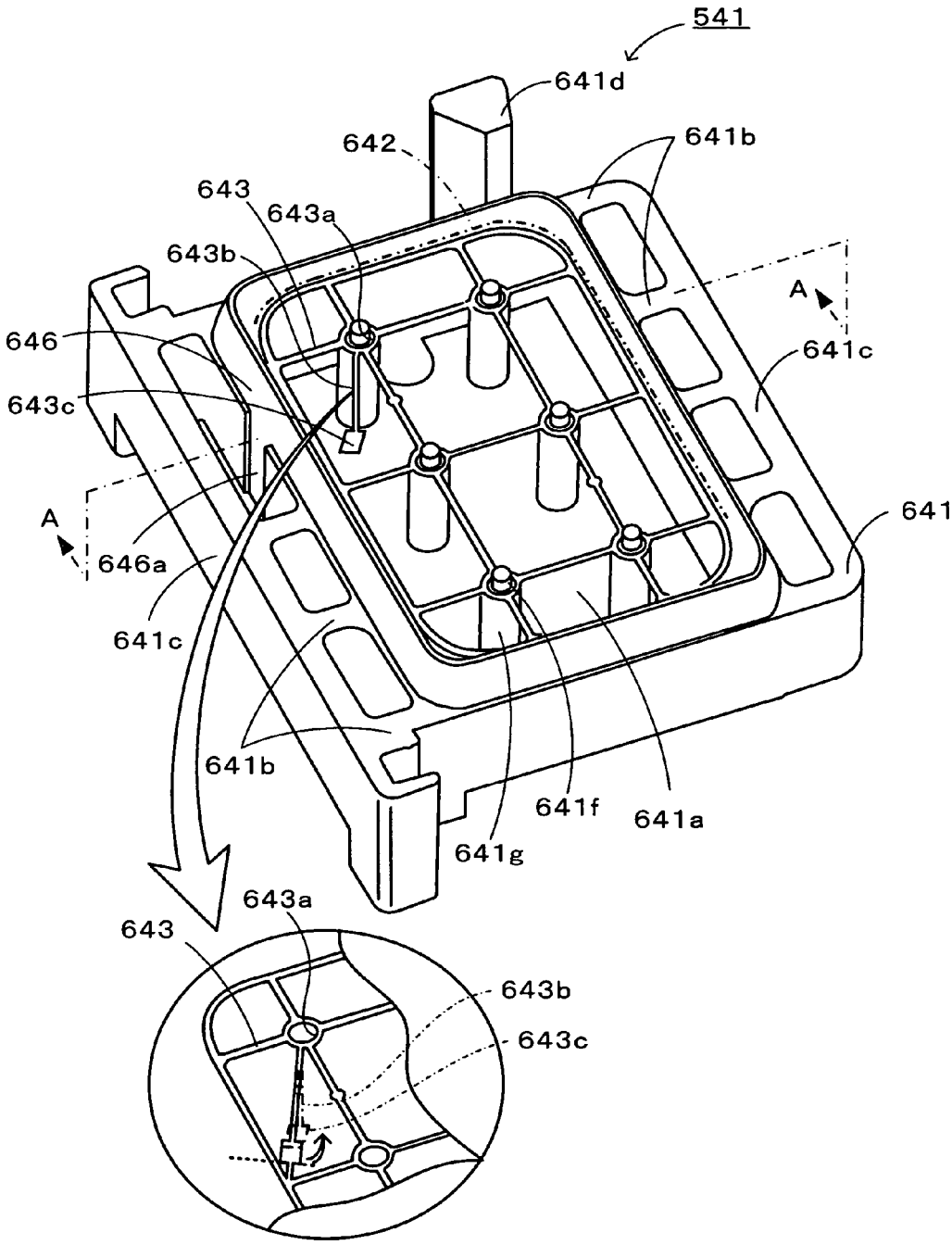
FIG. 12 is a perspective view of a cap 541, as viewed in a downward direction obliquely from above.
Figure 13:
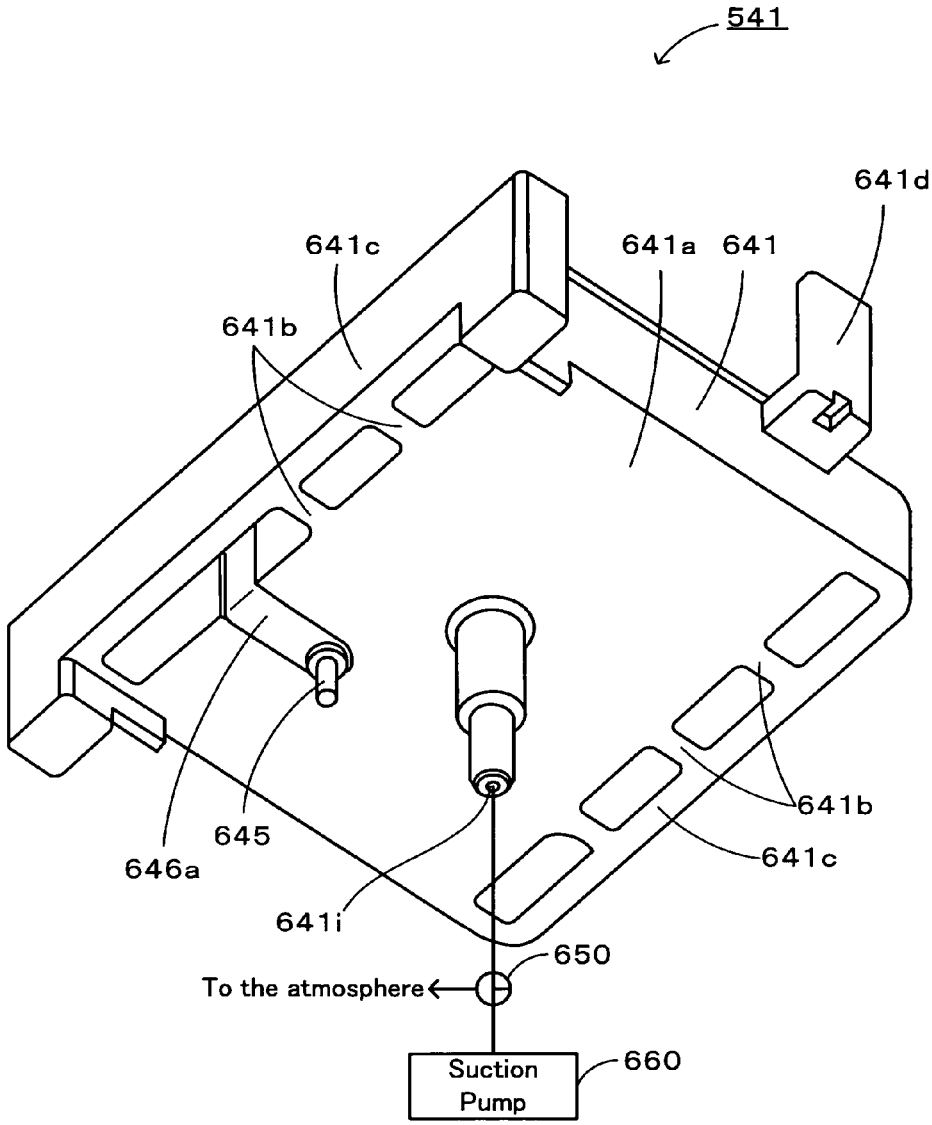
FIG. 13 is a perspective view of the cap 541, as viewed in an upward direction obliquely from beneath.
Figure 14:
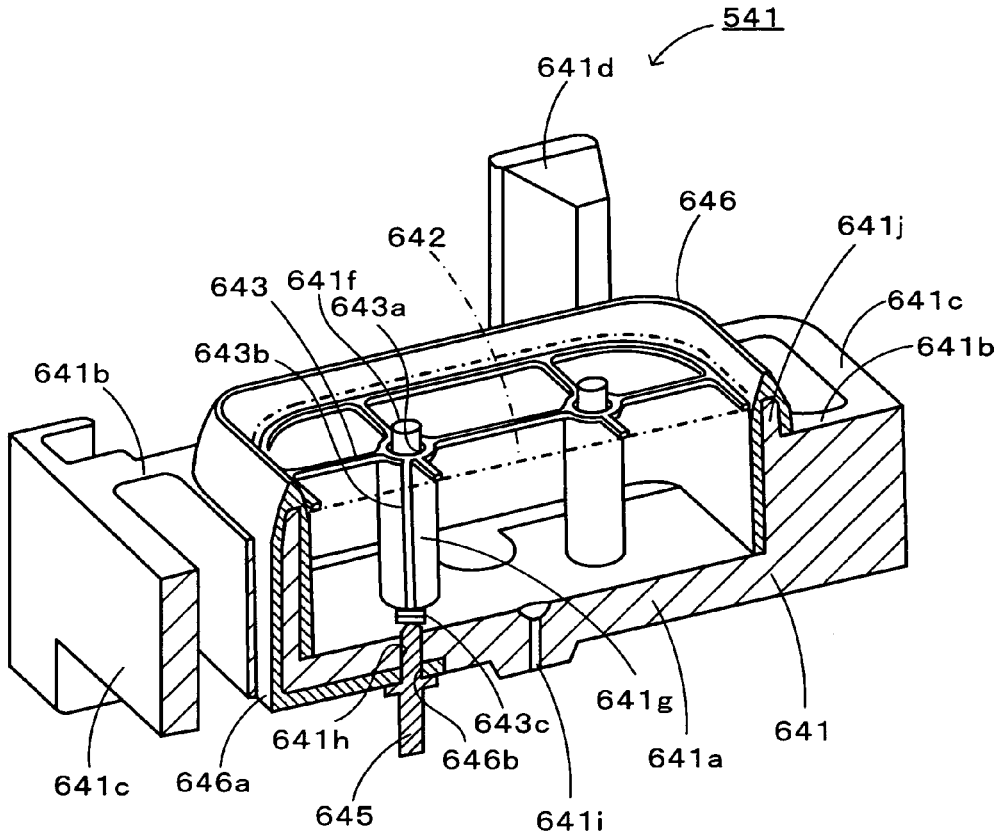
FIG. 14 is a cross sectional view of A-A of FIG. 12.
Figure 15:
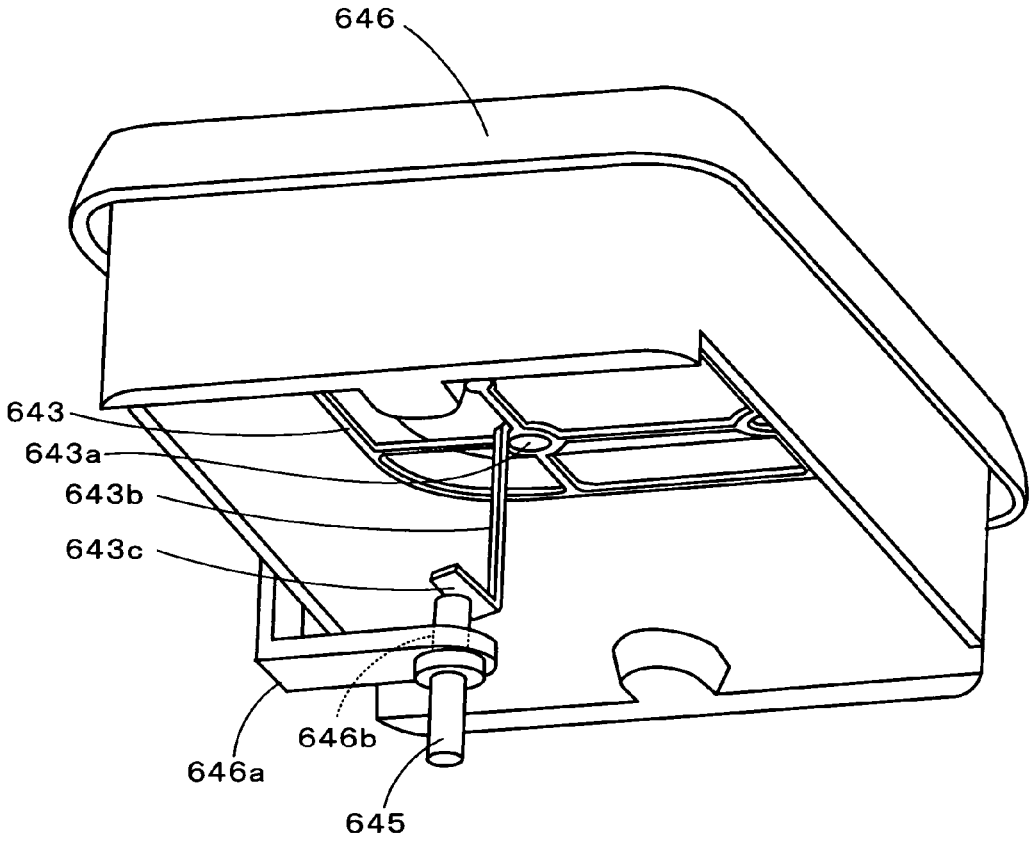
FIG. 15 is a perspective view of the cap 541, as viewed in an upward direction obliquely from beneath (with the box member 641 omitted).

Although the cap 41 has been used in the above embodiment, a cap 541, as illustrated in FIG. 12 to FIG. 14, may alternatively be used. FIG. 12 is a perspective view of the cap 541, as viewed in a downward direction obliquely from above. FIG. 13 is a perspective view of the cap 541, as viewed in an upward direction obliquely from beneath. FIG. 14 is a cross sectional view of A-A of FIG. 12. FIG. 15 is a perspective view of the cap 541, as viewed in an upward direction obliquely from beneath (with the box member 641 omitted). In FIGS. 12 and 14, the ink-absorbing member 642 is indicated only in outline (chain line).

As illustrated in FIGS. 12 to 15, the cap 541 comprises a box member 641 made of synthetic resin, a cover member 646 that covers the periphery of the opening of the box member 641, an ink-absorbing member 642 contained in the box member 641, a regulating member 643 arranged on the top surface of the ink-absorbing member 642, and an electrode pin 645 inserted into a through hole 641*h* provided on the base of the box member 641 and electrically connected with the regulating member 643.

As illustrated in FIG. 14, the box member 641 is integrally formed, by synthetic resin, of a box body 641*a* in which a concave portion is formed by opening the top of an almost rectangular body and a through hole 641*h* and a suction port 641*i* are provided on the base of the concave portion; a reinforcing wall 641*c* provided on the longitudinal wall of the box body 641*a* by way of a plurality of ribs 641*b*; a columnar body 641*d* extending upward from the box body 641*a*; and a plurality of supporting rods 641*g* standing on the base of the concave portion of the box body 641*a* and having heads 641*f* at the end. The columnar body 641*d* serves similarly to the columnar body 93 of the above embodiment. Specifically, when the carriage 22 returning to the home position (See FIG. 6) pushes and moves the columnar body 641*d*, the cap 541 moves up obliquely and sticks to the print head 24. In addition, the through hole 641*h* is designed so as to have a slightly larger diameter than that of the end of the electrode pin 645.

As illustrated in FIG. 15, the cover member 646 is a member integrally formed by an electrically insulating elastomer (such as synthetic resin), and corresponds to the print head-abutting rim of the present invention. As illustrated in FIG. 14, the cover member 646 covers the periphery of the box member 641, and specifically covers the entire internal surface, apexes, and a part of the lateral surface of the surrounding wall 641*j* of the box body 641*a*. In addition, within the cover member 646, the part covering the apex of the surrounding wall 641*j* of the box member 641, i.e., the periphery of the opening, is designed to be higher than the top surface of the ink-absorbing member 642. In addition, the cover member 646 has a belt strip 646*a* that goes around to the back of the base of the box body 641*a* after extending down to the lateral surface of the surrounding wall 641*j* of the box body 641*a*. At positions where the belt strip 646*a* goes to the back of the base of the box body 641*a*, vertically penetrating seal holes 646*b* are formed. The seal holes 646*b* have a smaller diameter than that of the end of the electrode pin 645, and are formed to be almost coaxial with the through hole 641*h*. Such a cover member 646 is made by injection molding. More specifically, the cover member 646 is made as follows: the box member 641 is sandwiched by an upper mold and a lower mold (not shown), generating a space, which has the same shape as the cover member 646, between the two molds and the box member 641. Then, a molten elastomer is poured into the space, and the two molds are removed after they have been cooled and solidified. In the lower mold, a cylindrical protrusion having the same diameter as the seal hole 646*b* is provided at a part that will be a seal hole 646*b*. However, formation of the elastomer and fixing of the pin can be completed simultaneously by means of fixing the electrode pin 645 to the part in advance, and the pouring the elastomer.

A description of the ink-absorbing member 642 is herein omitted as it is identical to the ink-absorbing member 142 of the above embodiment.

As illustrated in FIG. 14, the regulating member 643 is a mesh stainless (SUS) thin sheet and not only curbs from swelling in an upward direction the ink-absorbing member 642 that absorbs ink, but also serves as an opposing electrode that is opposite to the print head when nozzles are inspected for clogging. The regulating member 643 is formed like a mesh and allows ink ejected from the print head 24 (See FIG. 2) to transfer to the ink-absorbing member 642. In addition, the regulating member 643 is caulked by inserting heads 641*f* of six supporting rods 641*g* that are integrally formed on the base of the box member 641 into circular holes 643*a*, provided at crossing points of the mesh at a time that it is arranged on the ink-absorbing member 642, and by heating and pressurizing the heads 641*f*. The heads 641*f* in FIGS. 12 and 14 are illustrative of a condition before caulking takes place. From one of the crossing points of the regulating member 643 is formed an extension 643*b* that is bent in a downward direction by almost 90°, extending along the side of the supporting rod 61*a* and reaching the base of the concave portion of the box member 641*a*, and the lower end of the extension 643*b* is bent by almost 90° and provides an electrode connection unit 643*c*. The electrode connection unit 643*c* is arranged at a position that blocks the through hole 641*h*. As illustrated from the circle of FIG. 12, the extension 643*b* is made by diagonally cutting out a linear member from one of the crossing points of the mesh, and by then bending it. Thus, a part of the stainless plate that would otherwise be thrown away can be used effectively. In addition, since the regulating member 643, the extension 643*b*, and the electrode connection unit 643*c* are integral, the number of parts can be smaller than in a case in which they are separate members, and manufacturing costs can thereby be reduced.

As illustrated in FIG. 14, the electrode pin 645 is a stainless rod-like member having a flange almost at the center, and a pointed end. The electrode pin 645 is fixed by being inserted so as to penetrate the seal hole 646*b* and the through hole 641*h* from below the box member 641, and the end presses from bottom to top the electrode connection unit 643*c* provided in the extension 643*b* of the regulating member 643. Thus, with the end of the electrode pin 645 pressing the electrode connection unit 643*c*, the electrode connection unit 643*c* is elastically deformed at the point that is folded. Thus, even if, as a result of long-term use, caulking of the regulating member 643 weakened and the ink-absorbing member 642 slightly pushed up the regulating member 643, elasticity of the electrode connection unit 643*c* is such that contact between the electrode pin 645 and the electrode connection unit 643*c* can be maintained. In this context, as the diameter of the seal hole 646*b* is formed so as to be slightly smaller than the end of the electrode pin 645, the electrode pin 645 is pressed into the seal hole 646*b*, and sealing is secured because the cover member 646 in which the seal hole 646*b* is formed is made of elastomer. Consequently, the electrode pin 645 penetrates the box member 641 in an air-tight and liquid-tight manner. Furthermore, the number of parts can be smaller than in a case in which the sealing unit is provided separately from the cover member 646, and manufacturing costs can thereby be reduced. The electrode pin 645 is grounded to the ground by way of the mechanical frame 80 (See FIG. 1).

As illustrated in FIG. 13, a suction pump 660 is connected to a suction port 641*i* penetrating the base of the box member 641 by way of a three-way valve 650. The three-way valve 650 switches communication of the suction port 641*i* to the suction pump 660 or to the atmosphere. In order to forcibly suck in ink or the like, that has been absorbed in the ink-absorbing member 642 by the suction pump 660, not only the print head 24 (See FIG. 2) is abutted onto the cover member 646, but also the suction pump 660 is driven after the three-way valve 50 causes the suction port 641*i* to communicate with the suction pump 351. In this manner, negative pressure is generated inside the internal space surrounded and sealed by the print head 24 and the box member 641, thereby enabling ink or the like that has been absorbed in the ink-absorbing member 642 to be sucked in forcibly. After such forcible suctioning, the suction pump 660 is stopped and the three-way valve 650 communicates the suctioning port 641*i* to the atmosphere, and thus the negative pressure of the internal space reverts to atmospheric pressure.

If a cap 541 of such a type is adopted, almost similar operations of a nozzle inspection or cleaning can be performed as in the above embodiments. However, although the atmospheric open valve 150 is provided in the above embodiments, instead thereof, a three-way valve 650 is provided herein and is thus operated. In addition, although the effects obtained when the cap 541 is adopted are similar to those obtained in the course of the above embodiments, the electrode pin 645 can be simply assembled if in advance the electrode pin 645 is made to stand at a position opposite to a base in advance when the electrode pin 645 is fitted into the box member 641 with the cover member 646, and the electrode pin 645 is inserted into the seal hole 646*b* and the through hole 641*h* by pushing down from above the box member 641 that is almost perpendicular to the electrode pin 645. In addition, the cap 541 may be applied to the flashing area, or to the nozzle inspection dedicated area. In such cases, if it is used for the flashing area, or for the inspection dedicated area, the columnar body 641*d* or the suction port 641*i* will no longer be necessary and thus may be omitted.

This application bases its claim for priority on the Japanese Patent Applications No. 2005-347775, filed on Dec. 1, 2005, and No. 2006-292655, filed on Oct. 27, 2006, and both of which are hereby incorporated by reference in their entirety.

What is claimed is:

1. An electrode container box used for inspection of nozzles for clogging on the basis of a waveform of an output signal at a print head or an opposing electrode that is opposed to the print head, at a time that an operation of ejecting print recording liquid from a nozzle of the print head to the opposing electrode is performed in a state in which a potential difference has been generated between the print head and the opposing electrode, the electrode container box comprising:

a box member that is provided separately from the print head and has an open top and that contains the opposing electrode, an electrode member that penetrates inside and outside the box member in a liquid-tight manner, and that is electrically connected to the opposing electrode;

a recording liquid-absorbing member that is contained in the box member and capable of absorbing the print recording liquid; and a regulating member that is placed on a surface of the recording liquid-absorbing member, that is made in a shape that enables recording liquid ejected from the print head to be transferred to the recording liquid-absorbing member, and that curbs the recording liquid-absorbing member from swelling in an upward direction;

wherein the regulating member also serves as the opposing electrode.

2. The electrode container box according to claim 1, wherein the electrode member is pressed into a through hole provided in the box member.

3. The electrode container box according to claim 1, wherein the electrode member is threaded into a screw hole provided in the box member.

4. The electrode container box according to claim 1 wherein the electrode member penetrates the box member and is sealed by a sealing member.

5. The electrode container box according to claim 1 wherein the electrode member penetrates the base of the box member.

6. The electrode container box according to claim 1 wherein in the regulating member, an electrode connection unit that is electrically connected with the electrode member is integrally formed.

7. The electrode container box according to claim 6, wherein the electrode connection unit is pressed by the electrode member, elastically deformed, and electrically connected with the electrode member.

8. The electrode container box according to claim 1, wherein the opposing electrode is arranged on a rear surface of the recording liquid-absorbing member.

9. The electrode container box according to claim 1, comprising:

a print head-abutting rim provided around a periphery of an opening of the box member so as to be higher than the surface of the recording liquid-absorbing member.

10. The electrode container box according to claim 9, wherein the print head-abutting rim has electrical insulation.

11. The electrode container box according to claim 10, wherein the print head-abutting rim is made of an elastomer having electrical insulation, and is made integral with a seal unit that enables the electrode member to penetrate inside and outside the box member in a liquid-tight manner.

12. The electrode container box according to claim 9, comprising:

a suction port that is used when the print recording liquid absorbed in the recording liquid-absorbing member is sucked out to the exterior, in a condition in which the print head-abutting rim is in contact with the print head.

13. The electrode container box according to claim 12, being used at a time that the nozzles of the print head are cleaned.

14. A printing device, comprising:

the electrode container box according to claim 1, and a print mechanism that performs printing by ejecting recording liquid from the nozzles of the print head toward a medium.

15. A nozzle inspection method, including steps of:

(a) arranging a print head so that it is opposite to the opposing electrode provided in the electrode container box according to claim 1; and (b) after step (a), inspecting nozzles for clogging on the basis of a waveform of an output signal at a print head or an opposing electrode that is opposed to the print head, at a time that an operation of ejecting print recording liquid from a nozzle of print head to an opposing electrode is performed in a state in which a potential difference has been generated between the print head and the opposing electrode.

* * * * *